United States Patent [19]

Sinclair

[11] Patent Number: 4,611,362

[45] Date of Patent: Sep. 16, 1986

[54] BUFFING WHEEL

[75] Inventor: Harold C. Sinclair, Spartanburg, S.C.

[73] Assignee: Milliken Research Corporation, Spartanburg, S.C.

[21] Appl. No.: 718,503

[22] Filed: Apr. 1, 1985

[51] Int. Cl.[4] ..... B24D 13/04

[52] U.S. Cl. ..... 15/230.15

[58] Field of Search ..... 15/230, 230.13, 230.15, 15/230.16, 230.19

[56] References Cited

U.S. PATENT DOCUMENTS

| | | | |
|---|---|---|---|
| 1,504,272 | 8/1924 | Schlegel | 15/230,15 |
| 2,090,814 | 8/1937 | Seybert | 15/230 X |
| 3,160,905 | 12/1964 | Lansing | 15/230.15 |
| 3,346,903 | 10/1965 | Darak | 15/230.15 X |
| 3,451,093 | 6/1969 | McAleer | 15/230.16 X |

*Primary Examiner*—Chris K. Moore

*Attorney, Agent, or Firm*—Earle R. Marden; H. William Petry

[57] ABSTRACT

A buffing wheel which employs a weft inserted, warp knit fabric which, when formed into the buffing wheel, has the weft inserted yarns projecting radially therefrom and the knit warp yarns extending in the peripheral direction thereof.

5 Claims, 4 Drawing Figures

BUFFING WHEEL

This invention relates to an improved buffing wheel utilizing a weft inserted, warp knit fabric so arranged that the weft inserted yarn extends radially outward from the spoke of the wheel.

At the present, woven buffing material is conventionally used and cut along a bias and the material formed into a buffing wheel with the bias cut edge at the periphery of the buffing wheel, thereby presenting both the warp and filling yarns at 45° angles to the periphery and to the work piece. Heretofore this bias arrangement has been considered as providing the most desirable buffing action. However, this bias cut woven material is relatively expensive and has to be sewn and cut to reduce fraying during use in the buffing wheel.

Therefore, it is an object of the invention to provide a buffing wheel which employs a weft inserted, warp knit fabric that eliminates the cutting and sewing operation and offers a buffing wheel which is cheaper in cost and has a longer service life.

Other objects and advantages of the invention will become readily apparent as the specification proceeds to describe the invention with reference to the accompanying drawings, in which.

Figure 1:
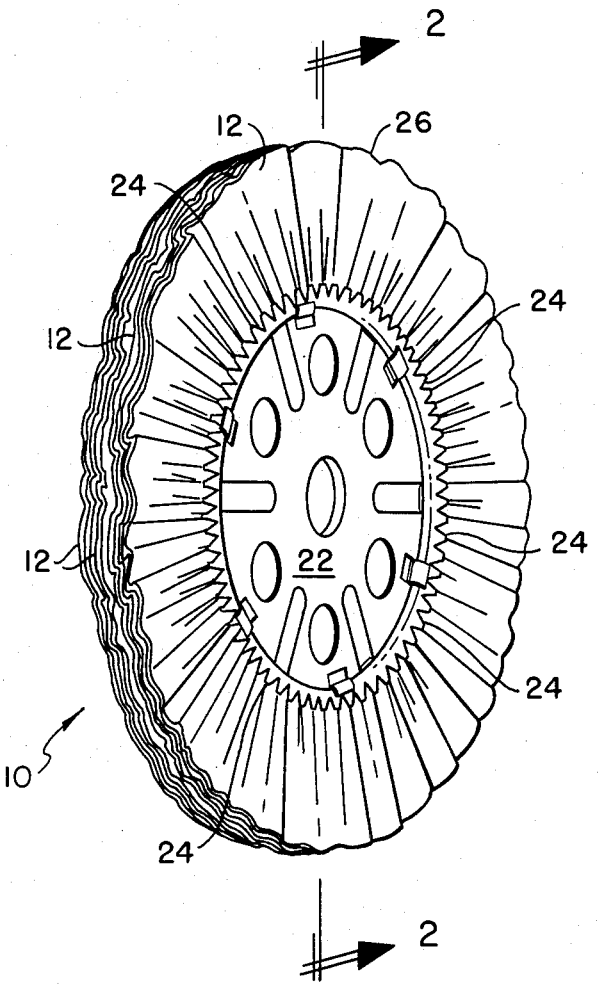
FIG. 1 is a perspective view of the new and improved buffing wheel.
Figure 4:
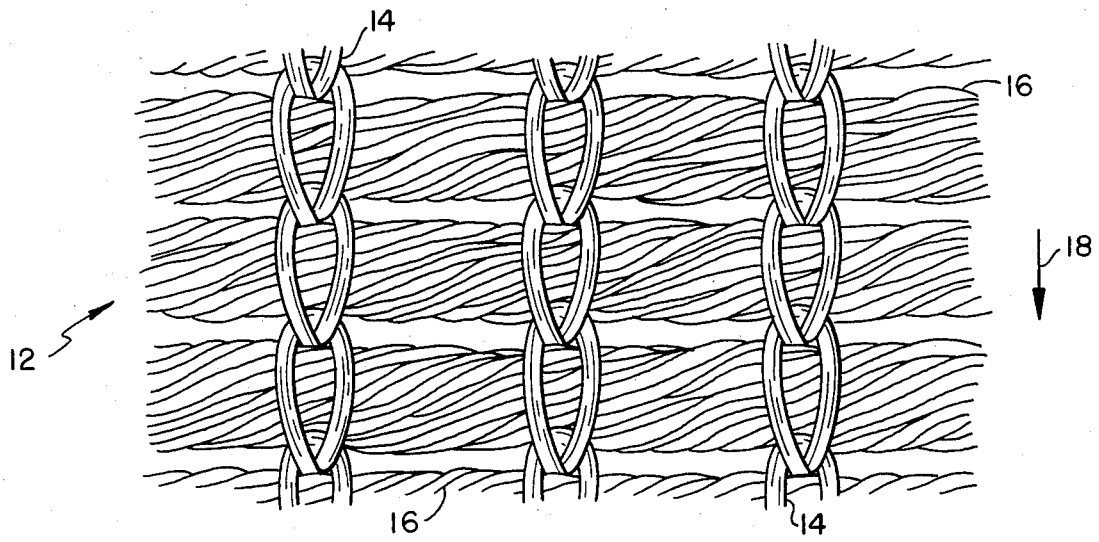
FIG. 4 is a schematic view of the weft inserted knit fabric employed in the construction of the buffing wheel represented in FIGS. 1–3.

Looking now to the drawings, FIG. 1 is a perspective view of the new and improved buffing wheel 10 constructed using the fabric 12 shown in FIG. 4. The fabric 12 basically is a warp knit fabric using a 40 denier, continuous filament, polyester chain stitch yarn 14 spaced across the fabric to hold the weft inserted, 12's single cotton yarn 16 in position in the fabric 12.

Figure 2:
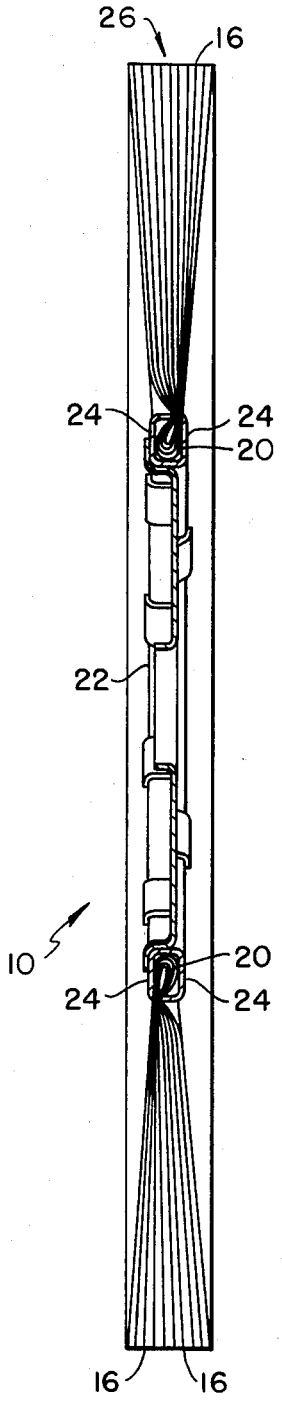
FIG. 2 is a cross-section view taken on line 2—2 of FIG. 1.
Figure 3:
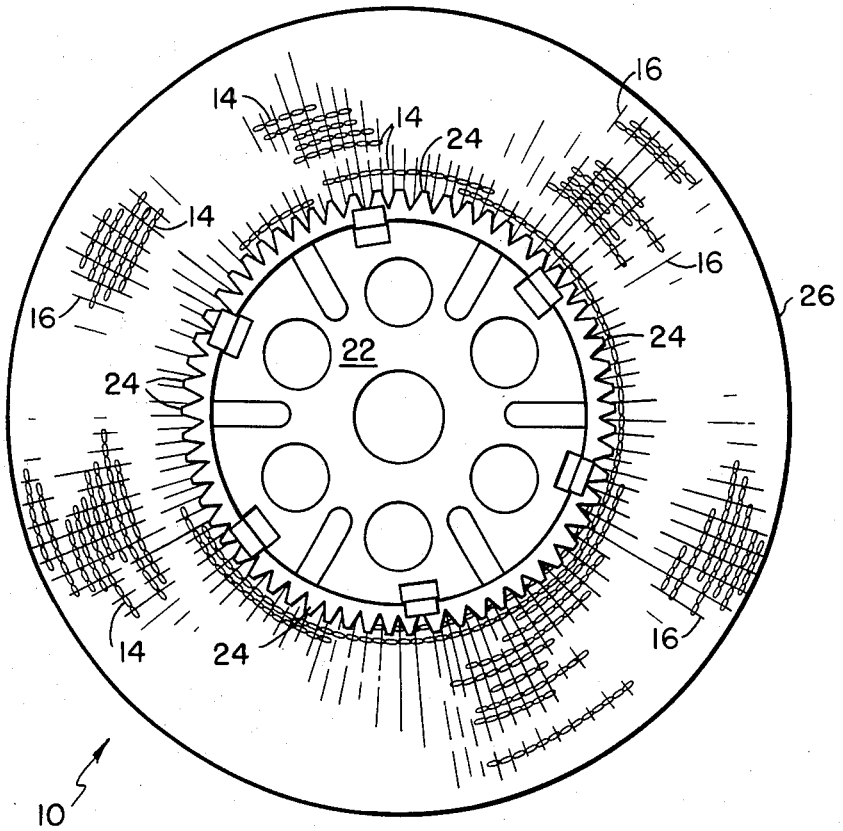
FIG. 3 is an elevation view of one side of the buffing wheel.

The buffing wheel 10 is formed by cutting the fabric 12, after it has been coated with an acrylic or starch to provide stiffness thereto, into strips of pre-determined length in the machine direction indicated by the arrow 18 and a plurality of the cut strips supplied to and wound around a forming ring to provide multiple layers of fabric. The fabric 12 is then pressed downwardly, by any suitable means, so the centerline position 20 of the fabric strip forms a U-shape so that the cotton fill yarns 16 extend radially therefrom while the chainstitch yarns 14 extend in the circumferential direction. Then the buffing wheel core 22 is inserted and the teeth 24 thereof turned upwards to clamp the downwardly held fabric to form and secure the fabric into the configuration shown in FIGS. 1–3. The other periphery edges 26 of the buffing wheel 10 are then trimmed. The forming ring is now removed to free the buffing wheel. It is understood, if desired, that the forming ring can be removed at any time after the insertion of the core 22 depending on how it is desired to provide the trimming or treating operation.

In the preferred form of the invention, the fabric 12 has nineteen wales per inch and fifty weft insertions per inch. The fabric 12 is knit in 60" widths and has a weight of 4.57 ounces/square yard and is approximately, by weight, 90% cotton and 10% polyester. Four layers of this fabric are wound twice around the forming ring so that when the fabric is forced downwardly into the right, there will be sixteen outer peripheral edges 26 available as a buffing surface. The stiffening material for the fabric is preferably a starch or an acrylic but can be any suitable material that will provide the stiffening necessary for the desired buffing manipulation.

It is obvious that the new and improved buffing wheel requires less steps to manufacture due to the elimination of the cutting on the bias and sewing operations to prevent fraying. This is due to the construction of the fabric in which the chain stitch warp yarn locks in the filling yarn and prevents the twist from the filling yarn from coming out during use as a buffing wheel.

Although the preferred embodiment of the invention has been described in detail, it is contemplated that many changes may be made without departing from the scope or spirit of the invention and it is desired that the invention be limited only by the claims.

I claim:

1. A buffing wheel having a central base portion and outer buffing portion supported on said base portion, said buffing portion comprising a plurality of strips of weft inserted, warp knit fabric superimposed on one another, said superimposed fabrics being folded lengthwise with the fold abutting the base portion and the fabric on either side of the fold arranged edgewise with respect to the base portion, said fabric having chain stitch wales extending in the peripheral direction, said wales holding the weft inserted yarns in a radial direction from said central base portion.

2. The buffing wheel of claim 1 wherein the weft inserted yarn is substantially cotton.

3. The buffing wheel of claim 1 wherein the chain stitch yarn is substantially polyester.

4. The buffing wheel of claim 3 wherein said weft insertion yarn is substantially all cotton.

5. The buffing wheel of claim 4 wherein said fabric is substantially 90% cotton and 10% polyester.

* * * * *